US007921822B2

(12) United States Patent
Bugescu

(10) Patent No.: US 7,921,822 B2
(45) **Date of Patent: *Apr. 12, 2011**

(54) SWITCHABLE DUAL LIFTER

(75) Inventor: Florin Bugescu, Canton, MI (US)

(73) Assignee: Schaeffler KG, Herzogenaurach (DE)

( * ) Notice: Subject to any disclaimer, the term of this patent is extended or adjusted under 35 U.S.C. 154(b) by 359 days.

This patent is subject to a terminal disclaimer.

(21) Appl. No.: 12/165,900

(22) Filed: Jul. 1, 2008

(65) Prior Publication Data

US 2009/0007872 A1 Jan. 8, 2009

Related U.S. Application Data

(60) Provisional application No. 60/947,528, filed on Jul. 2, 2007.

(51) Int. Cl.
*F01L 1/14* (2006.01)

(52) U.S. Cl. ..... 123/90.52; 123/90.48; 123/90.16

(58) Field of Classification Search ..... 123/90.52, 123/90.48, 90.16, 90.5
See application file for complete search history.

(56) References Cited

U.S. PATENT DOCUMENTS 6,606,972 B2 * 8/2003 Wenisch et al. ..... 123/90.17
7,284,519 B1 * 10/2007 Best et al. ..... 123/90.48
7,637,237 B2 * 12/2009 Evans et al. ..... 123/90.48

* cited by examiner

*Primary Examiner* — Zelalem Eshete
(74) *Attorney, Agent, or Firm* — Lucas & Mercanti, LLP

(57) ABSTRACT

The switchable dual lifter has two hydraulic lash adjusters, one which is fixed within the common housing, and the other which is movable to allow for deactivation of one of the two valves acted on by the dual lifter. Using the dual lifter with a switchable hydraulic lash adjuster allows for closing of one of the adjacent valves while allowing the other of the adjacent valves to operate.

6 Claims, 6 Drawing Sheets

SWITCHABLE DUAL LIFTER

FIELD OF THE INVENTION

This invention relates to internal combustion engines and, more particularly, to dual lifters used in a valve train in an internal combustion engine.

BACKGROUND OF THE INVENTION

Dual lifters have two side-by-side hydraulic lash adjusters mounted in a common elongated housing and are used in internal combustion engines with four or more valves to simultaneously act on two side-by-side valves of the same cylinder. One end of the housing has a cam follower and the other end is open so that the hydraulic lash adjusters can contact push-rods or finger followers of the side-by-side valves. Such dual lifters act simultaneously on both valves so as to affect opening and closing of the valves.

There is a need to de-activate one of the side-by-side valve when using a dual lifter in order to increase fuel efficiency of the engine.

OBJECTS OF THE INVENTION

The object of this invention is a switchable dual lifter that allows for the deactivation of one of the valves of the side-by-side valves on a cylinder while maintaining the other valve of the side-by-side valves active.

This and other objectives and advantages of the invention will become obvious from the following description.

SUMMARY OF THE INVENTION

The invention achieves the above objects by using a switchable hydraulic lash adjuster in the dual lifter. An oil inlet port is provided in the common housing to activate and deactivate the switchable hydraulic lash adjuster between the locked mode and the unlocked mode. In the unlocked mode the hydraulic lash adjuster follows the cam motion without activating the valve.

Broadly, the present invention can be defined as a switchable dual lifter for two adjacent valves in a cylinder of an internal combustion engine comprising:

- a common elongated housing;
- a cam contact member mounted at one end of said housing;
- a first axial bore in said housing, one end of said first axial bore adjacent said cam contact member and the other end of said first axial bore open;
- a second axial bore in said housing, one end of said second axial bore adjacent said cam contact member and the other end of said second axial bore open;
- a first hydraulic lash adjuster mounted in said first axial bore, one end of said first hydraulic lash adjuster adapted to contact a push-rod of one of two adjacent valves;
- a second hydraulic lash adjuster movably mounted in said second axial bore, one end of said second lash adjuster adapted to contact a push-rod of the other of the two adjacent valves;
- a locking member positioned at the other end of said second lash adjuster, movable with said second lash adjuster and engageable for selectably locking the housing and the second hydraulic lash adjuster together for coincidental, reciprocal movement; and
- a lost motion spring positioned between said locking member and said one end of said second axial bore so as to allow said second hydraulic lash adjuster to move when said locking member is unlocked.

Preferably, a sleeve extends upward above said housing from said second axial bore. The sleeve has an internal opening with a diameter equal to the diameter of second axial bore and the internal opening and second axial bore are concentric. The sleeve acts as a guide for said second hydraulic lash adjuster as it extends above the housing.

An oil inlet is provided in the housing to lock and unlock the locking member.

Preferably, the housing is cylindrical in shape.

The first hydraulic lash adjuster can be replaced with a switchable hydraulic lash adjuster similar to the second hydraulic lash adjuster, the common housing can be provided with an oil inlet for the locking member of the second switchable lash adjuster, and a sleeve can be provided above the first bore to guide the reciprocal movement of the second switchable lash adjuster.

The invention will now be described more closely with reference to the attached drawings.

DETAILED DESCRIPTION OF THE DRAWINGS

Figure 1:
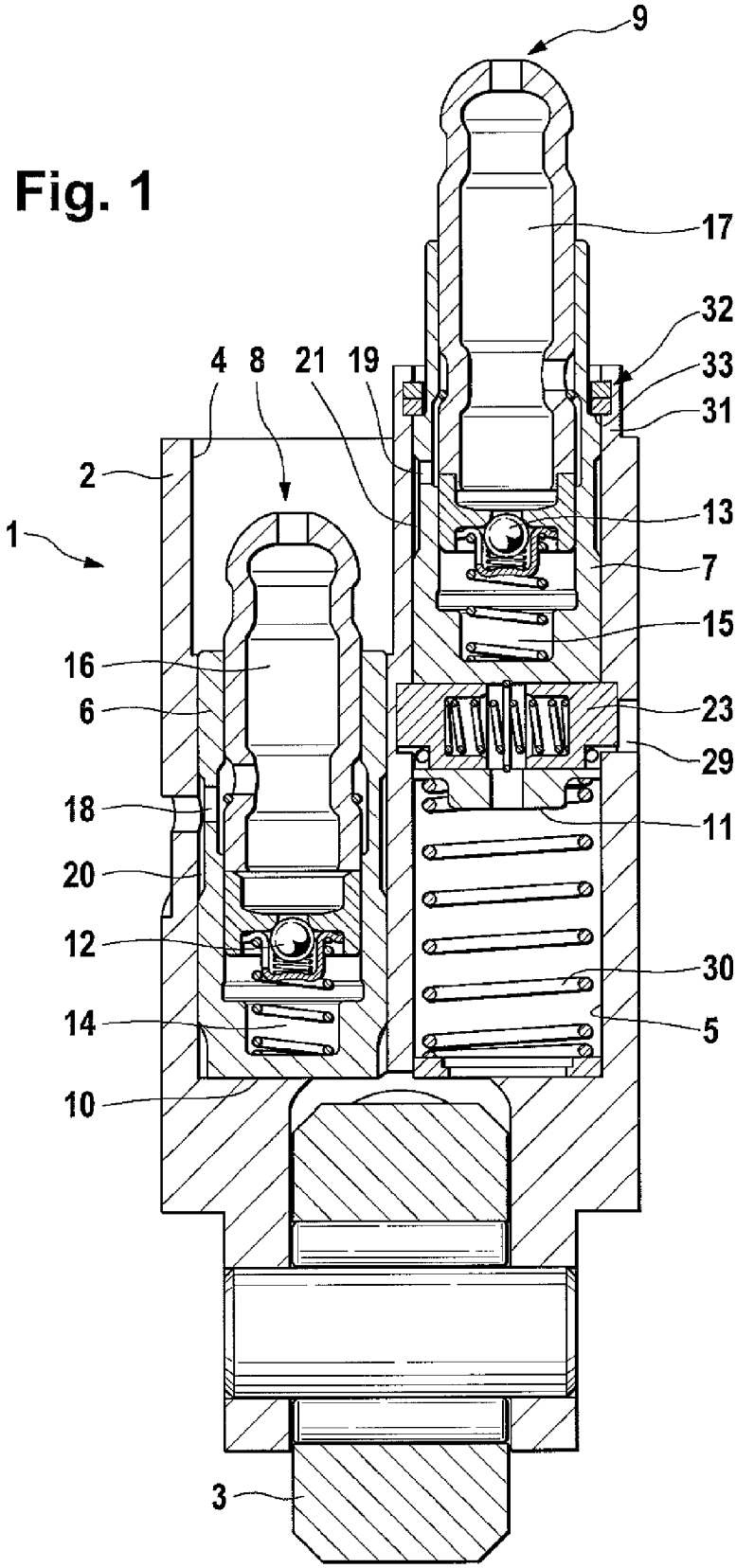
FIG. 1 is a longitudinal cross section through a switchable dual lifter according to the present invention shown in the locked position.
Figure 2:
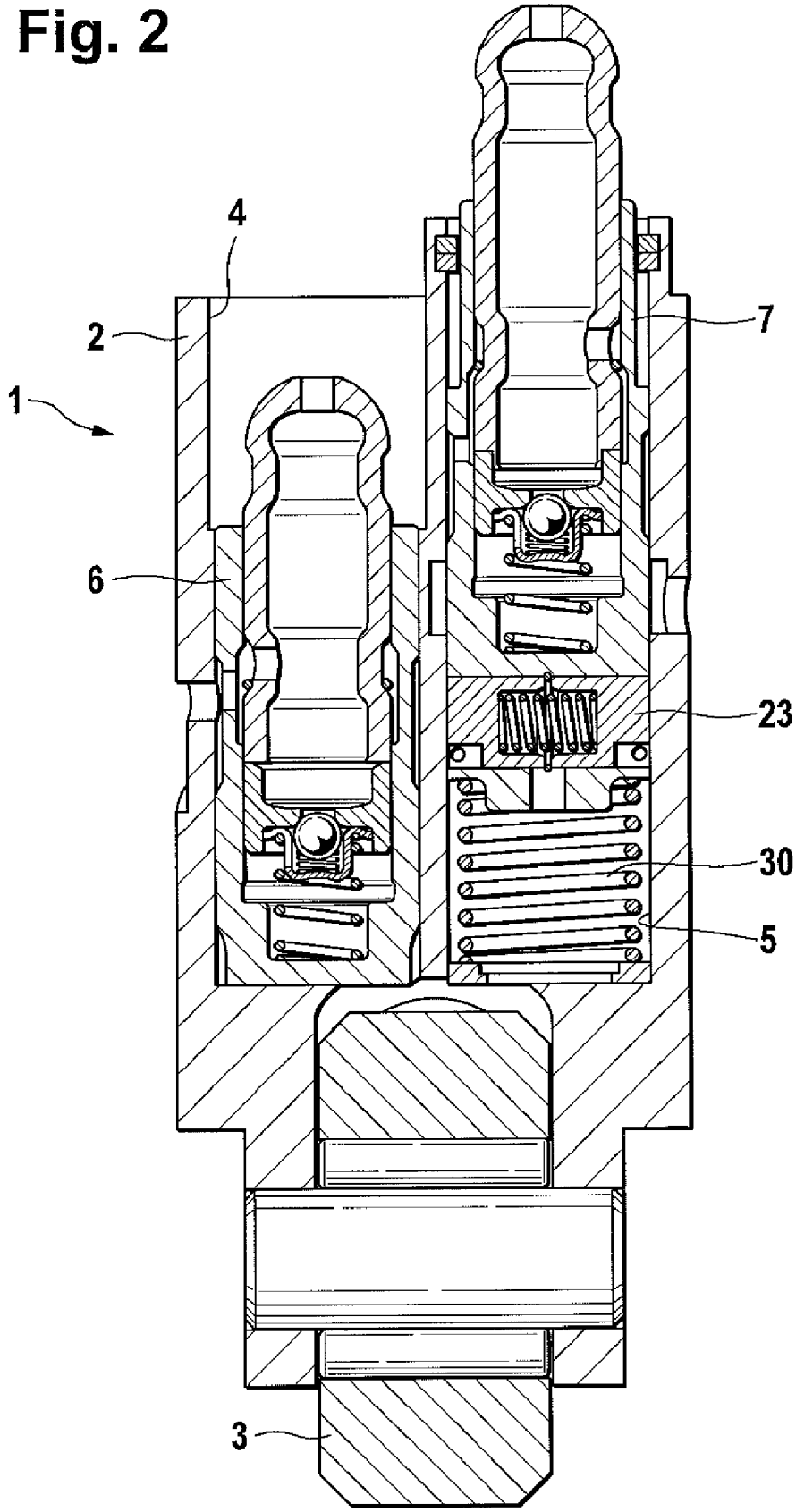
FIG. 2 illustrates the switchable valve of FIG. 1 in the unlocked position.

FIG. 1 illustrates switchable dual lifter 1 having outer cylindrical housing 2. Roller 3 acts as a cam contact member and is mounted at one end of housing 2. Inside housing 2 is first axial bore 4 and second axial bore 5. Mounted in first axial bore 4 is first hydraulic lash adjuster 6. Mounted in second axial bore 5 is second hydraulic lash adjuster 7.

Figure 4:
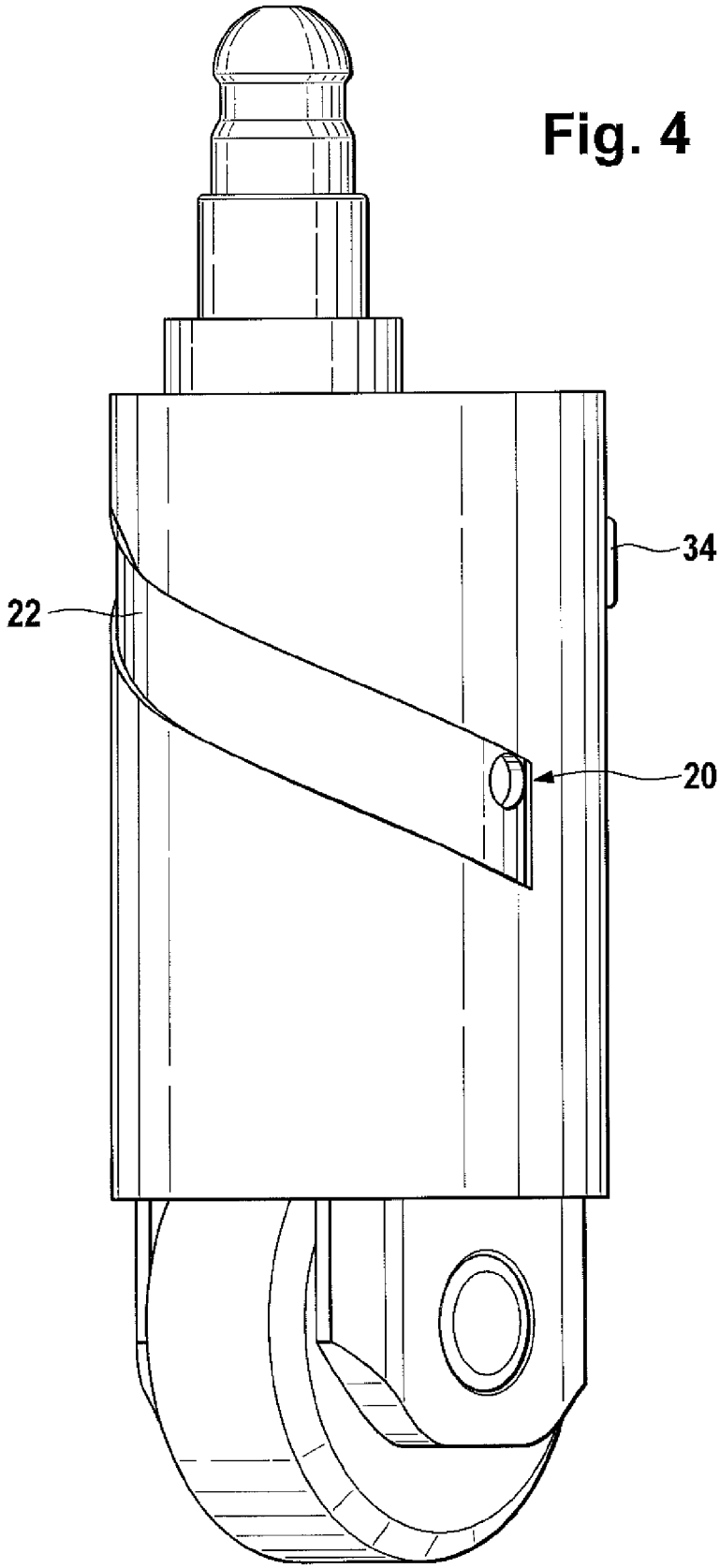
FIGS. 4 and 5 illustrate the oil holes in the exterior of the housing of the dual lifter.
Figure 5:
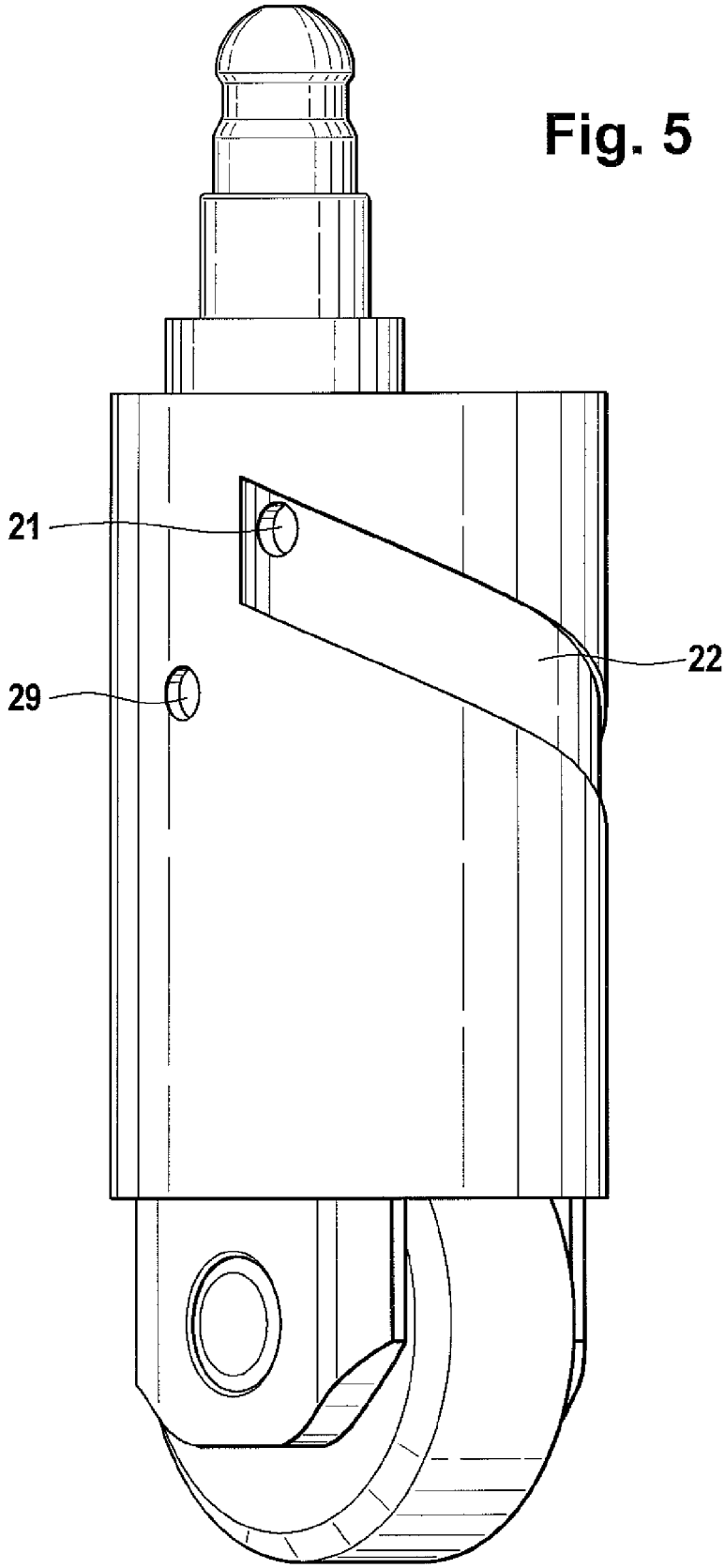

First hydraulic lash adjuster 6 and second hydraulic lash adjuster 7 each have distal ends 8, 9, base ends 10, 11, one-way valves 12, 13 which divide high pressure chambers 14, 15 from reservoirs 16, 17. Oil inlets 18, 19 of the hydraulic lash adjusters 6, 7 provide a means for oil to enter into reservoirs 16, 17. Oil inlets 20, 21 are in housing 2 and allow oil from the engine block into the respective hydraulic lash adjusters 6, 7. As can be seen in FIG. 4, channel 22 connects oil inlets 20, 21.

Oil is provided to channel 22 by the engine block in order to provide oil to the hydraulic lash adjusters 6, 7.

Figure 3:
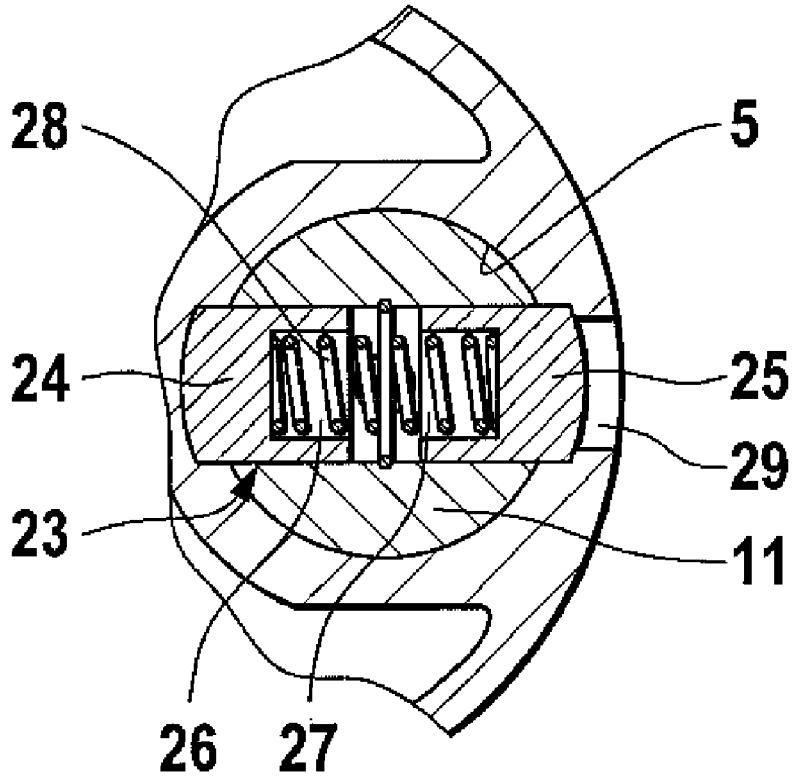
FIG. 3 shows a traverse cross-section through the locking member in the second bore.

Locking member 23 is mounted in base 11. As shown in FIG. 3, locking member 23 comprises pistons 24, 25 which are pushed in a radial direction into respective ports 26, 27 by spring 28. Port 27 connects to oil inlet 29. Port 27 is in fluid communication with port 26 such that one hydraulic median is provided through inlet 29 to ports 26, 27, simultaneously. In this manner hydraulic median can be routed to the radial outer ends of pistons 24, 25 to thereby cause compression spring 28 to be compressed and allow pistons 24, 25 to retract into base 11 of second hydraulic lash adjuster 7. When pistons 24, 25 retract into base 11, they leave ports 26, 27, thereby unlocking second hydraulic lash adjuster 7 from outer cylindrical housing 2. Ports 26, 27 are in the side wall of second axial bore 5.

Lost motion spring 30 is positioned between the bottom of second axial bore 5 and base end 11 of second hydraulic lash adjuster 7. When pistons 24, 26 are retracted into base 11, lost motion spring 30 allows second hydraulic lash adjuster 7 to move in a reciprocal motion with the cam and thereby deactivate the valve on which second lash adjuster 7 operates.

Sleeve 31 extends outward above outer cylindrical housing 2. Sleeve 31 has stops 32 which mate with stops 33 of second hydraulic lash adjuster 7. The interaction between stops 32 and 33 prevent further upward movement of second lash adjuster 7 when second lash adjuster 7 is in the unlocked mode.

Other conventional locking members can be employed in order to lock second hydraulic lash adjuster 7 into outer cylindrical housing 2.

When second hydraulic lash adjuster 7 is in the locked mode, it acts on its respective push-rod and valve in order to open and close the valve. This means that the push-rod that is acted on by second hydraulic lash adjuster 7 is shorter than the push-rod that is acted on by first hydraulic lash adjuster 6.

When second hydraulic lash adjuster 7 is in a locked mode, both side by side valves will open simultaneously due to the action of dual lifter 1.

When second hydraulic lash adjuster 7 is in the unlocked mode, the valve that is acted upon by first hydraulic lash adjuster 6 will open and close in response to the movement of the cam interacting with roller 3, while lost motion spring 30 will allow second hydraulic lash adjuster 7 to move in a reciprocal manner so as to maintain the contact with its push-rod but to allow the valve to remain closed.

When operating an engine having four valves per cylinder, two intake valves and two exhaust valves, two switchable dual lifters in accordance with the present invention can be employed such that one of the intake valves and one the exhaust valves of the cylinder can be maintained in a closed position while the other of the intake valves and the exhaust valves is opened and closed due to the cam action on the dual lifters. This closing of one of the intake valves and one of the exhaust valves allow for improvement in fuel consumption.

Anti rotational pin 34 is used to prevent rotation of switchable dual lifter and is used to guide the lifter.

It will be appreciated that a dual valve has been shown with two lash adjusters, however, three hydraulic lash adjusters could be employed in the common outer cylindrical housing.

Figure 6:
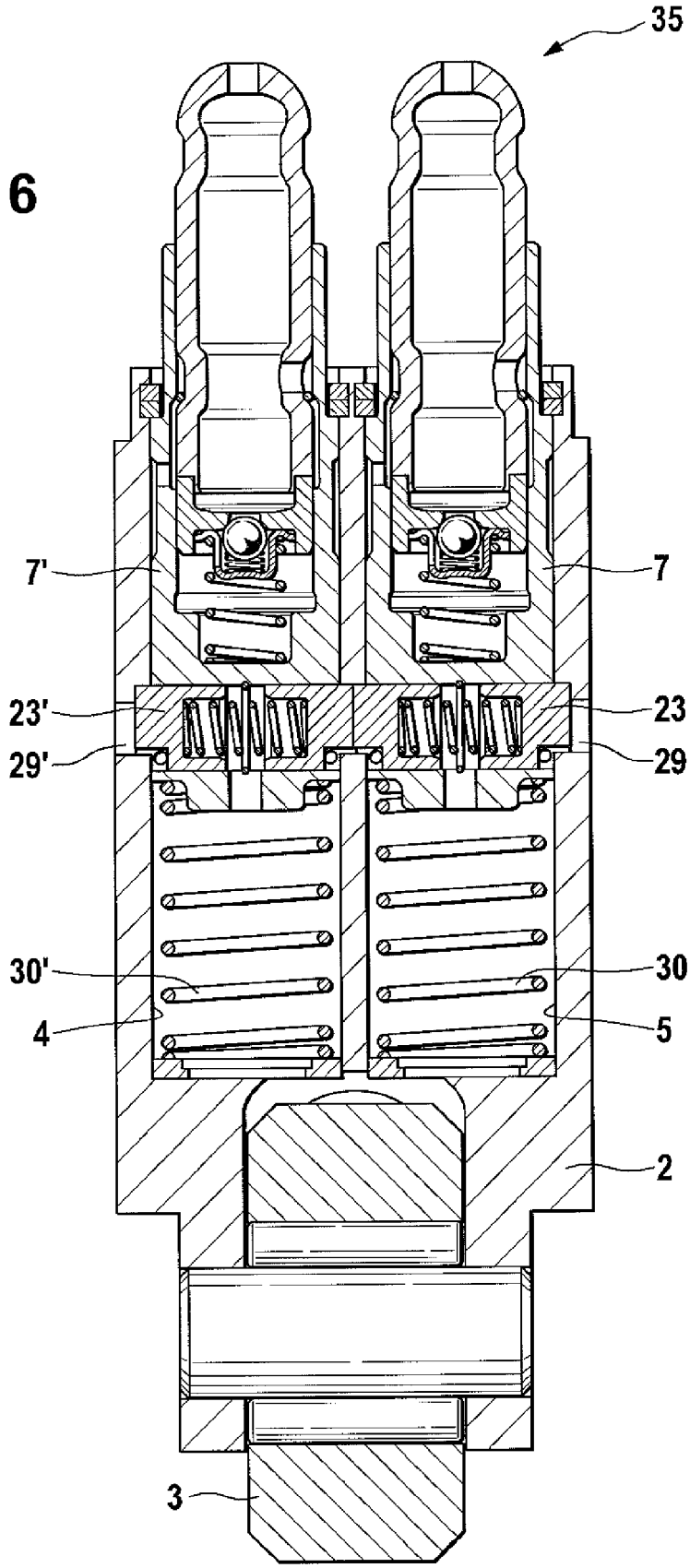
FIG. 6 illustrates the switchable dual lifter with two switchable hydraulic lash adjusters.

In FIG. 6, switchable dual lifter 35 has both lash adjusters, switchable. Such an arrangement allows for control of which one of the two valves to shut down, left or right, and allows the whole cylinder to be shut down, i.e. none of the valves operate.

LIST OF DESIGNATIONS

1 Switchable dual lifter
2 Outer cylindrical housing
3 Roller
4 First axial bore
5 Second axial bore
6 First hydraulic lash adjuster
7 Second hydraulic lash adjuster
7' Second hydraulic lash adjuster
8 Distal end of 6
9 Distal end of 7
10 Base end of 6
11 Base end of 7
12 One-way valve 6
13 One-way valve 7
14 High pressure chamber 6
15 High pressure chamber 7
16 Reservoir of 6
17 Reservoir of 7
18 Oil inlet of 6
19 Oil inlet of 7
20 Oil inlet for 6 in 2
21 Oil inlet for 7 in 2
22 Channel
23 Locking member
23' Locking member
24 Piston
25 Piston
26 Port
27 Port
28 Spring
29 Oil inlet
29' Oil inlet
30 Lost motion spring
30' Lost motion spring
31 Sleeve
32 Stop in sleeve
33 Stop in 7
34 Anti rotational pin
35 Switchable dual lifter

What is claimed:

1. A dual lifter for two adjacent valves in a cylinder of an internal combustion engine, comprising:

a common elongated housing;

a cam contact member mounted at one end of said housing;

a first axial bore in said housing, having one end adjacent said one end of said housing and the other end open;

a second axial bore in said housing, having one end adjacent said one end of said housing and the other end open;

a first hydraulic lash adjuster mounted in said first axial bore, one end of said first lash adjuster adapted to contact a push-rod of one of two adjacent valves;

a second hydraulic lash adjuster movably mounted in said second axial bore, said second lash adjuster having one end adapted to contact a push-rod of the other of the two adjacent valves;

a locking member positioned at the other end of said second hydraulic lash adjuster for selectively locking the second hydraulic lash adjuster together with said housing for coincidental, reciprocal movement with said housing; and a lost motion spring positioned between said locking member and said one end of said second axial bore so as to allow said second hydraulic lash adjuster to move when said locking member is unlocked.

2. The lifter of claim 1 wherein said locking member comprises pistons which are pushed radially outward by a spring into ports which are in the side wall of the second axial bore.

3. The lifter of claim 1 wherein a sleeve extends upward from said second axial bore, said sleeve having an internal opening concentric to and equal in diameter to said second axial bore.

4. The lifter of claim 1 wherein said housing is cylindrical.

5. The lifter of claim 1 wherein said housing has a first oil inlet for said first hydraulic lash adjuster, a second oil inlet for said second lash adjuster and said first oil inlet and said second oil inlet are connected by a channel.

6. The lifter of claim 1 wherein said first hydraulic lash adjuster is a switchable hydraulic lash adjuster.

* * * * *